United States Patent [19]

Carlson

[11] 4,397,417

[45] Aug. 9, 1983

[54] FOLDER FOR COUPONS

[75] Inventor: Albert W. D. Carlson, Roosevelt Island, N.Y.

[73] Assignee: Rivercross Learning Corp., Roosevelt Island, N.Y.

[21] Appl. No.: 197,916

[22] Filed: Oct. 17, 1980

[51] Int. Cl.[3] ..... B65D 27/04

[52] U.S. Cl. ..... 229/92.3; 229/70

[58] Field of Search ..... 229/92.3, 70, 71, 92.7, 229/1.5 R, 72, 68 R; 150/39; 283/56

[56] References Cited

U.S. PATENT DOCUMENTS

| | | | |
|---|---|---|---|
| 202,589 | 4/1878 | Rogers | 229/92.7 |
| 488,005 | 12/1892 | Griffith | 150/39 |
| 1,276,101 | 8/1918 | Oakley | 229/72 |
| 1,404,193 | 1/1922 | Dietsche, Jr. | 229/72 |
| 1,948,290 | 2/1934 | Dygert et al. | 229/92.7 |
| 3,140,817 | 7/1964 | Fitzgerald | 229/72 |
| 3,229,893 | 1/1966 | Stein | 229/68 R |
| 3,426,961 | 2/1969 | Allison | 229/70 |

*Primary Examiner*—Stephen P. Garbe

*Attorney, Agent, or Firm*—Darby & Darby

[57] ABSTRACT

A folder for coupons or other like articles which can be made from a single sheet of paper in which the coupons are on a strip attached to the rear flap of the folder and folded accordian fashion, with each coupon being at a progressively vertically stepped location relative to the coupon next closest to the folder rear flap, there being a window in the folder front flap through which a portion of each coupon can be viewed.

9 Claims, 4 Drawing Figures

FOLDER FOR COUPONS

BACKGROUND OF THE INVENTION

Various types of advertising coupons are well known. Such coupons include, for example, so-called "cents-off" coupons, discount coupons for use in places such as car rentals, theaters, movies, admission tickets, etc. Such coupons are distributed in high volume and, in order to reduce costs, are generally distributed in large numbers at a time.

One conventional method for distributing such coupons comprises printing individual coupons and then placing a number of these coupons in an envelope. This approach is not entirely satisfactory since the cost of stuffing the coupons into the envelope is relatively high. Another disadvantage with having coupons in the envelope is that there is no view of all of the coupons available to the consumer. For the consumer to find and obtain a particular coupon, he or she must sort through all of the them.

Another conventional arrangement for distribution is to print a number of coupons on a single large sheet of paper, which may be perforated. The consumer then tears or cuts off the individual coupons. Such an arrangement, while inexpensive, is not attractive. Also, the large sheet of paper is not convenient for a consumer to carry.

BRIEF DESCRIPTION OF THE INVENTION

The present invention relates to the packaging of coupons or other printed items in the form of a folder or book. The folder has front and rear flaps and attached to one of the flaps is a strip of a plurality of coupons or other printed items. The plurality of coupons are attached side to side with the top of each coupon lying progressively at a lower (or higher) position than the one next closest to the envelope flap to which the coupons are attached. The coupons are accordian folded in a stack to lie between the front and back flaps. The front flap of the folder is provided with a vertically extending window which is aligned with the top edges of the folded stack of coupons so that the upper edge of each of the coupons is viewable. Printing can be provided on the upper edge of each coupon so that a viewer can determine which of the coupons are in the book. The fold line between adjacent coupons can be perforated so that they can be torn apart.

It is therefore an object of the present invention to provide a novel folder for holding coupons or other similar articles.

A further object is to provide a folder of coupons or other similar articles wherein a series of the coupons and the folder holding them are made from a single sheet of paper.

An additional object is to provide a coupon folder wherein the folder has front and rear flaps, with the coupons being attached to the rear flap and being progressively stepped at lower or higher positions.

An additional object is to provide a folder for coupons or other similar articles which are accordian folded in a stack and placed between the covers of the folder, one of the covers having a window through which the coupons are viewable.

Other objects and advantages of the present invention will become more apparent upon reference to the following specification and annexed drawings in which.

Figure 1:
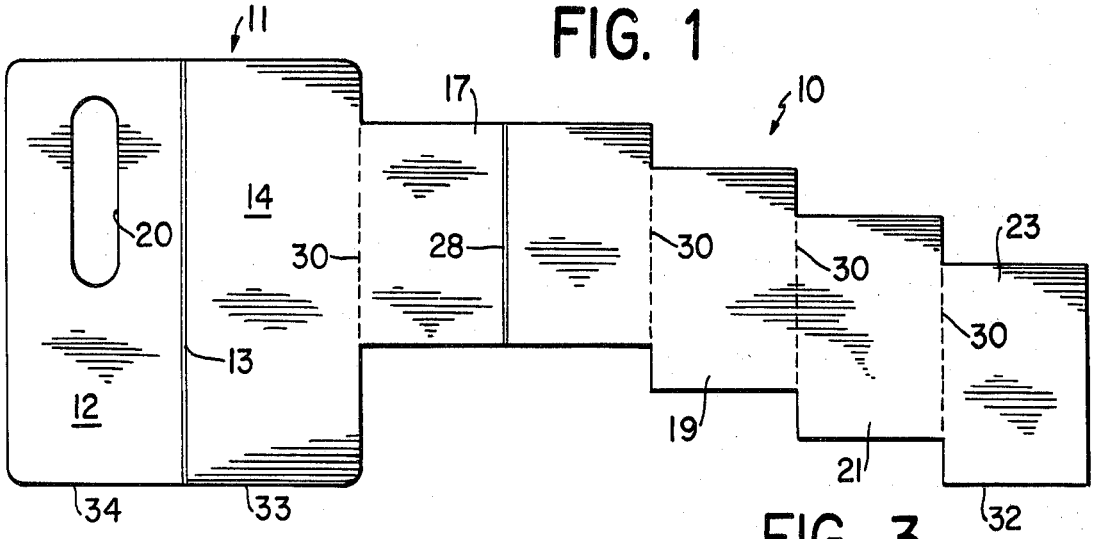
FIG. 1 is a plan view of the blank used in forming the folder in accordance with the invention.

Referring to the drawings, the coupon folder 10 includes a cover 11 having front and rear flaps 12 and 14. Flaps 12 and 14 are foldable along score line 13. Attached to the outer edge of the rear flap 14 is a series, or strip, of coupons or other similar articles which are identified as 17, 19, 21, 23, etc.

The cover 11 as well as the various coupons are cut from a single piece of paper, for example, by die cutting. This can be carried out by conventional machinery at a high speed and in an inexpensive manner. There is also cut into the front flap 12 a window 20, the purpose of which is described below. While the window is shown or being of a narrow vertical configuration, it can have other shapes.

In cutting the strip of coupons, each successive coupon to the right of the rear flap 14, as shown in FIG. 1, is stepped downwardly by a small amount. That is, the top of the coupon closest to the rear flap is at the highest position. The top of each coupon next further to the right is at a progressively lower position.

Each of the coupons 17, 19, 20, 21 . . . is preferably of the same height, although this is not absolutely necessary as long as the top edge of each coupon is stepped downwardly from the top edge of the next adjacent coupon closer to the back leaf 14 of the folder. The reverse arrangement can be used. That is, the top edge of the coupon closest to the rear flap can be at the lowest position and, the top edge of each coupon to the right at a successively higher position. The amount of the strip can be the same as between adjacent coupons or it can be different.

The coupons are also preferably of the same width, although, in some cases, a coupon can be made of larger width, for example, double, triple or even fractional sizes. A double width coupon is shown as 17 and, this can serve as a postal card if cut to the proper size, for example, $3\frac{1}{2}'' \times 5''$. In such case, it would be suitably imprinted with a picture or other advertising material on one side and with an address portion and a portion for a written message on the other side, as is conventional. A multiple width coupon, e.g., a post card, can be at any location in the strip. A multiple width coupon, such as 17, is folded several times back on itself, as would be the case with a fractional width coupon.

Where the coupons are to be torn from each other, the strip from which the coupons are formed can be suitable perforation lines shown as 30 to aid in the tearing of one piece from the next piece.

As explained previously, the front and back flaps as well as the coupons are cut from a single piece of paper by a suitable die cutting operation. The coupons are formed into a strip. Prior to or after the cutting operation, the coupons next can be printed with any desired information such as, for example, various types of value coupons, tickets to events, post cards, eetc. The printing can also be done on the flaps 12 and 14, both on the inside and the outside. The printing can be vertically, horizontally, from side-to-side, or any combination thereof.

In printing the strip containing the coupons, it is preferred that some identification be printed on the top edge of the coupon so that when the coupon strip is folded between the flap, as described below, this identification can be viewed.

The strip of coupons is accordian folded back into the back flap 14. The folding takes place along the perforation lines 30, separating the various coupons, as well as on a non-perforated folding line 28 for a multiple width item such as a postcard. The accordian fold is carried in a suitable folding machine. To assist in the folding, the last coupon in the series should have its bottom edge 32 in registry with the bottom edge 33 of at least the rear flap 14 of the cover. If the front end flap 12 is of the same size as the rear flap, then its bottom edge 34 will also be in registry with the bottom edge 32 of the last coupon. Thus, a single sheet of paper can be placed into a folding machine and the accordian folding accomplished in an automatic manner.

As an alternative to this (not shown), the bottom edges of all of the coupons can be on the same line with the bottom edges of the flaps. In this arrangement, each successive coupon will be of different height. Also, the top edge of the coupon attached to the flap can be made on the same line as the top edge of the flap and the bottom edge of the last coupon of the strip line with the bottom edge of the flap. In this way, full registration of the sheet of paper can be obtained during folding.

Figure 2:
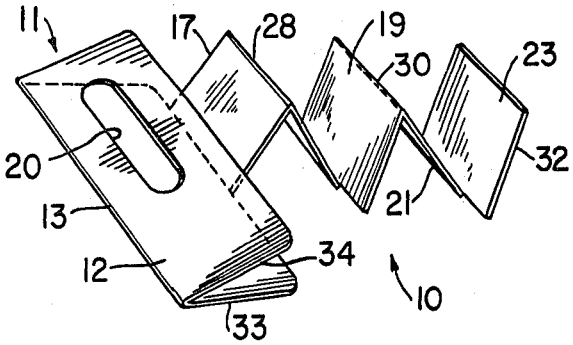
FIG. 2 is a perspective view showing how the coupons are folded.

FIG. 2 shows the coupon folder in an intermediate stage of unfolding. Here, as should be apparent, the consumer has taken the folder and has pulled out the strip of coupons to an extended position. The consumer can manipulate the accordian folded members in any desired manner, and can detach one or more of the coupons.

Figure 3:
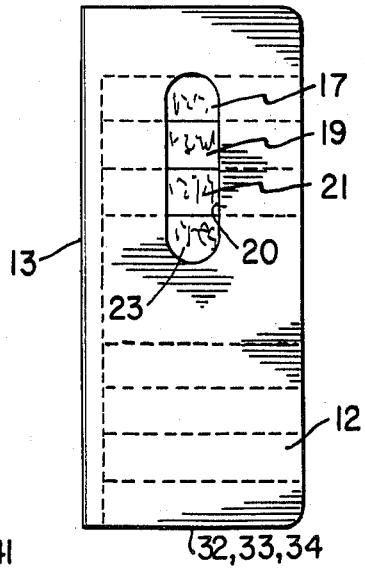
FIG. 3 is a front view showing the folder in the closed position with the coupons viewable through the window in the front flap.

FIG. 3 shows the coupon book in a fully folded condition. As seen, the top edges of each of the coupons is viewable through the window 20 and the information printed thereon is also viewable to the user. Thus, when the consumer gets the coupon folder, he is fully apprised as to what is in the folder and he can open the front flap and can easily proceed to the particular coupon that he has under consideration. While a window has been shown only as the front flap, it should be understood that it also can be located on the back flap or on both flaps.

If a coupon in an intermediate position in the strip is to be torn, the coupons to the right of it will be free of the folder flap. To overcome this disadvantage, the arrangement of FIG. 4 can be used. Here, each active usable area of the coupon is printed with an area having carrier strips 40, 42 at the top and bottom thereof. There are perforation lines 41, 43 between the carrier strip and the coupon active area. The active area is then torn out through the perforation lines at the top, bottom and sides. The strip of coupons is kept intact by the carrier strips, which now have an open central portion.

Figure 4:
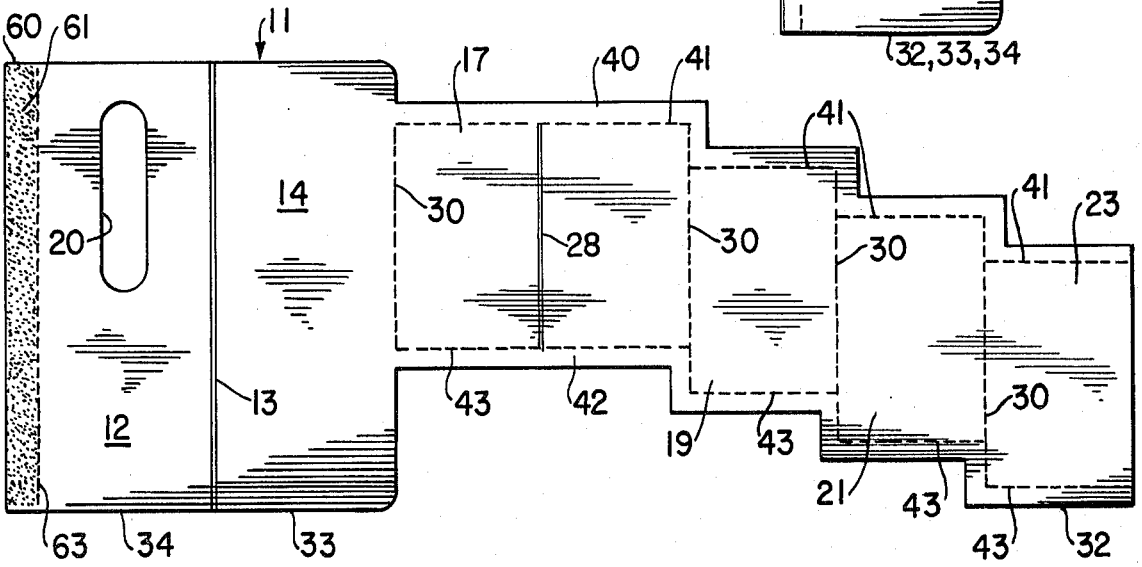
FIG. 4 is a plan view of a blank used in forming a further embodiment of the invention.

FIG. 4 shows a further modification of the invention in that a flap 60 with an adhesive surface 61 is attached to the front flap 12. The adhesive can be of any type, for example, either gummed or water activated. If desired, a score line 63 can be provided so that the flap 60 can be torn off. In this arrangement, the fully folded folder (FIG. 3) can be sealed for mailing or other purpsoes. It should be understood that flap 60 also can be used with the embodiment of FIG. 1.

What is claimed is:

1. A folder for coupons or the like comprising:

a cover having front and rear flaps which are foldable relative to each other, a plurality of coupons, each of said coupons having end edges and side edges, said coupons arranged side-to-side and having the side edges of adjacent coupons attached to each other with the first coupon of the plurality having one side edge attached to one of the front and rear flaps and the remaining coupons of the plurality attached side edge to side edge extending from the other side edge of said first coupon, said plurality of coupons forming a strip capable of being accordian folded along said attached side edges of adjacent coupons with the folded coupons being containable between the flaps of said cover when the flaps are closed, one of the edges of each of said coupons being at a position successively spaced from that of the corresponding edge of the coupon preceding it next closer to the flap to which the coupons are attached so that when said strip of coupons is accordian folded the portion of each coupon between its said one edge and said corresponding one edge of the next adjacent coupon is visible, at least some of said visible portions having indicia thereon, a window formed on one of the front and rear flaps at a position such that said visible portion of each of the said coupons between its said one edge and the corresponding one edge of the next adjacent coupon and any indicia thereon is simultaneously viewable through said window when said coupons are accordian folded and located between the folded flaps.

2. A folder as in claim 1 wherein the flaps and strip from which the coupons are formed comprise a single sheet of paper.

3. A folder as in claim 1 wherein score lines are provided between selected ones of the coupons.

4. A folder as in claim 1 wherein one of the end edges of at least one of the coupons is in registry with a corresponding one of the end edges of one of the front and rear flaps.

5. A folder as in claim 1 wherein selected ones of said coupons are of greater width between their side edges than others and fold back on themselves in the accordian fold.

6. A folder as in claim 1 wherein at least one of the coupons has a central area defined by score lines on each side thereof with strips on the top and bottom of said area to leave said at least one coupon attached to the others when the central area is removed.

7. A folder as in claim 1 further comprising a further flap on the outer edge of one of said front and rear flaps for sealing said front and rear flaps.

8. A folder as in claim 7 wherein said further flap has an adhesive thereon for sealing the front and rear flaps.

9. A folder as in claim 1 wherein said one edge of said coupon is one of the end edges so that the said one end edge and the visible portion of each coupon successively further from said one flap to which the strip is attached is at a successively different vertical position.

* * * * *